US005766043A

United States Patent [19]

Talend

[11] Patent Number: 5,766,043

[45] Date of Patent: Jun. 16, 1998

[54] TELEPHONE CONNECTOR

[75] Inventor: Donald R. Talend, Wauconda, Ill.

[73] Assignee: Corcom, Inc., Libertyville, Ill.

[21] Appl. No.: 609,962

[22] Filed: Feb. 29, 1996

[51] Int. Cl.[6] ..... H01R 23/02

[52] U.S. Cl. ..... 439/676; 439/607; 439/608; 439/695

[58] Field of Search ..... 439/607–610, 439/79, 695, 696, 701, 676

[56] References Cited

U.S. PATENT DOCUMENTS

| | | | |
|---|---|---|---|
| 4,648,678 | 3/1987 | Archer | 439/676 |
| 4,695,115 | 9/1987 | Talend | 439/76 |
| 4,850,902 | 7/1989 | Reed | 439/676 |
| 4,952,172 | 8/1990 | Barkus | 439/79 |
| 5,244,412 | 9/1993 | Hatch | 439/676 |
| 5,252,080 | 10/1993 | Pesson | 439/79 |
| 5,273,460 | 12/1993 | Arai | 439/609 |
| 5,378,172 | 1/1995 | Roberts | 439/676 |

*Primary Examiner*—J. J. Swann
*Attorney, Agent, or Firm*—Hill & Simpson

[57] ABSTRACT

An electrical jack which comprises a front housing, a back housing, and housing insert which are assembled together with electrical leads. A shield fits over the assembly so as to electrically shield it and to ground the unit to a suitable printed circuit board. Ferrite sleeves or a ferrite unit formed as a ferrite block are mounted in the back housing and the leads pass therethrough so as to remove undesired frequencies from the leads and a compact jack is formed.

19 Claims, 3 Drawing Sheets

TELEPHONE CONNECTOR

BACKGROUND OF THE INVENTION

1. Field of the Invention

This invention relates generally to an electrical jack and in particularly to a female connector for a jack such as a telephone connector.

2. Description of the Related Art

Telephone electrical jacks are known in the art and are used for making connections for various electrical equipment such as telephones. Some jacks have a different number in connectors in the lead frame so as to allow one or more telephones or other equipment to be operated. For example, see U.S. Pat. No. 4,695,115 entitled "TELEPHONE CONNECTOR WITH BYPASS CAPACITOR" assigned to the assignee of the present invention.

SUMMARY OF THE INVENTION

The present invention relates to an electro jack which has a front housing and a back housing and is covered by a shield. The back housing is formed with grooves so as to receive individual electrical leads and is formed with a recess for receiving a housing insert which holds cylindrical-shaped ferrite members through which the leads pass so as to filter undesired signals. Alternatively, the housing insert may comprise a ferrite block through which the leads pass. The shield fits over the assembly and has grounding extensions which extend to the printed circuit upon which the unit is mounted. The various parts of the electrical jack of the invention fit together and form an integral unit after assembly with the lead frame in position. The front housing is formed with a standoff so as to hold the jack away from the printed circuit.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 7:
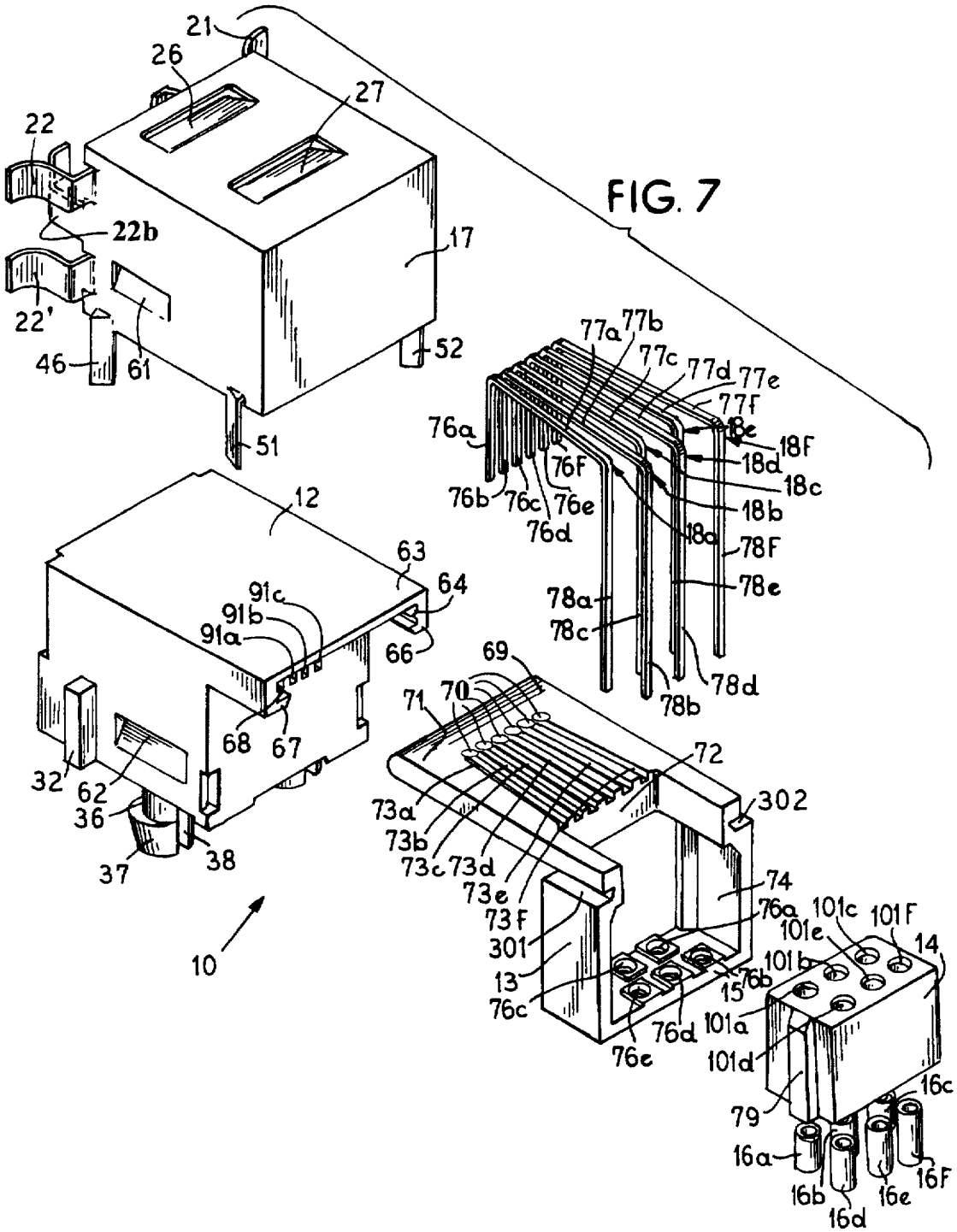
FIG. 7 is an exploded view illustrating the various components of the electrical jack of the invention.
Figure 8:
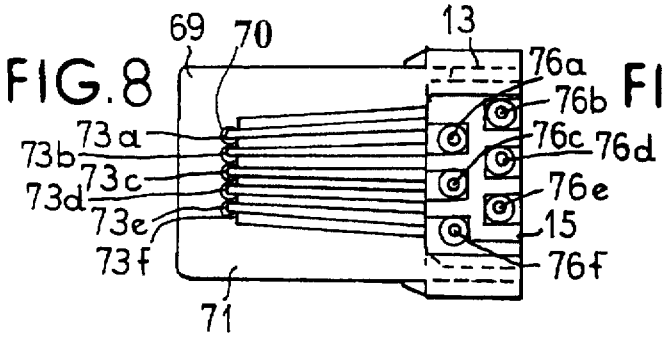
FIG. 8 is a top view of the back housing of the invention.
Figure 9:
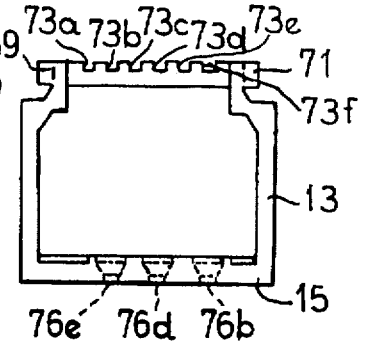
FIG. 9 is a rear plan view of the back housing of the invention.

FIG. 7 is an exploded view of the electrical jack of the invention which comprises a front housing 12 into which is received a back housing 13. Leads 18*a*–18*f* fit between the front housing 12 and the back housing 13.

A housing insert 14 fits into the rear end 74 of the back housing 13 and is formed with openings 101*a*–101*f* into which ferrite sleeves 16*a*–16*f* are received. The ferrite sleeves 16*a*–16*f* receive the ends 78*a*–78*f* of the leads 18*a*–18*f*. The ferrite sleeves 16*a*–16*f* serve as filters and remove undesired high frequencies from the signals passing through the leads 18*a*–18*f*. The housing insert 14 is formed with projections 79 and 81 which are received in the opening 74.

Grooves 73*a*–73*f* are formed in a top portion 72 of the back housing 13 and the center portions 77*a*–77*f* of the leads 18*a*–18*f* are received in the grooves 73*a*–73*f* and pass downwardly through openings 70. The portions 69 and 71 of the back housing 13 are connected and are slidably received into grooves 64 and 68 of the upper region 63 of the front housing 12. The front housing 12 has projections 91*a*–91*f* which form mating grooves through which the lead frame portions 77*a*–77*f* and 76*a*–76*f* which bend the leads 76*a*–76*f* in the back housing 13 when the back housing 13 is inserted into the front housing 12. The portion 63 is formed with grooves 64 and 68 and extensions 66 and 67 into which the portions 69 and 71 of the back housing 13 are slidably received. Grooves 64 and 68 of the front housing 12 mate with the extending portions 69 and 71 as the back housing 13 and the front housing 12 are fitted together.

Figure 1:
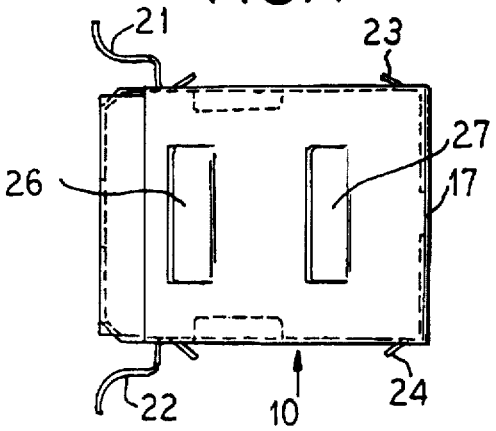
FIG. 1 is a top view of the jack of the invention.
Figure 2:
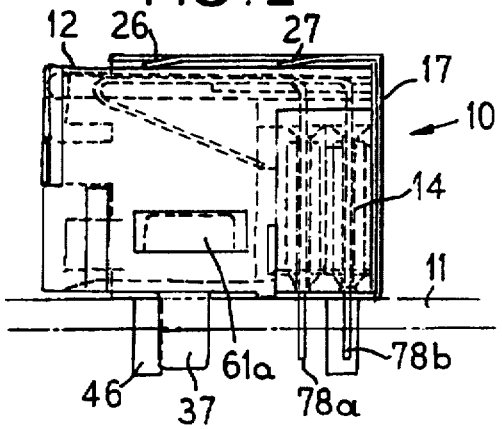
FIG. 2 is a sectional view illustrating the jack of the invention.
Figure 5:
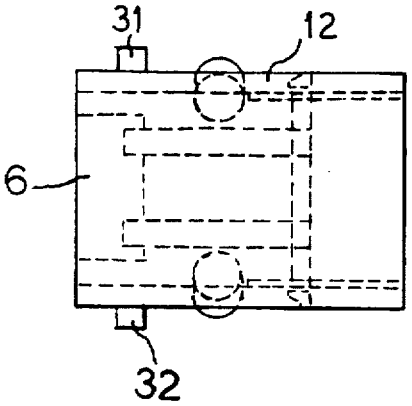
FIG. 5 is a plan view of the front housing.
Figure 6:
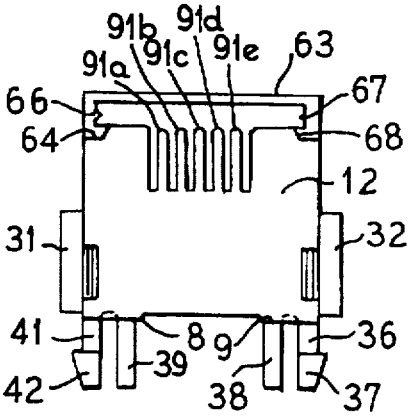
FIG. 6 is a rear view of the front housing.

The front housing 12 is shown in FIGS. 5 and 6 and has extending vertical members 31 and 32 attached to opposite sides and has downwardly extending projections 41, 39 and 42, 36, 37 and 38 which extend through the printed circuit board 11 as shown in FIG. 2 so as to hold the electrical jack to the printed circuit board 11.

As shown in FIG. 6, the front housing 12 is formed with standoffs 8 and 9 so as to space it from the printed circuit board 11 so that it does not make contact therewith.

Figure 3:
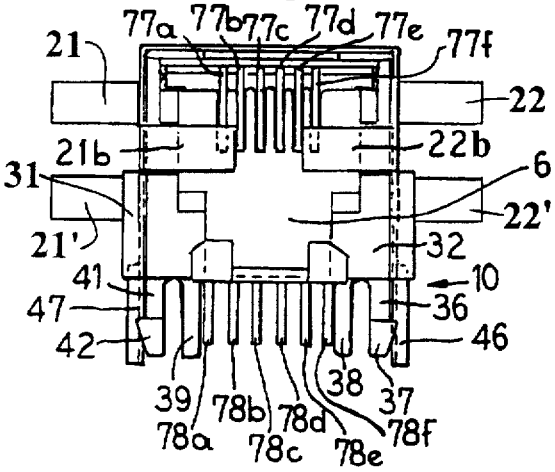
FIG. 3 is a front plan view of the jack.
Figure 4:
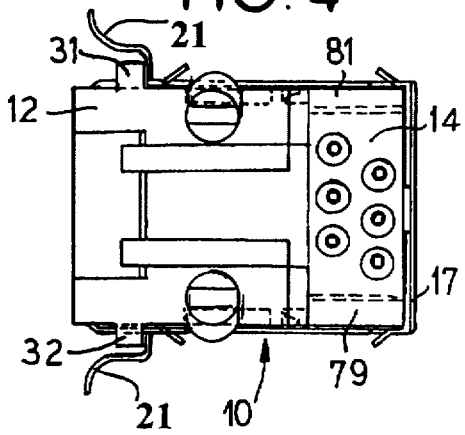
FIG. 4 is a bottom plan view of the jack.
Figure 10:
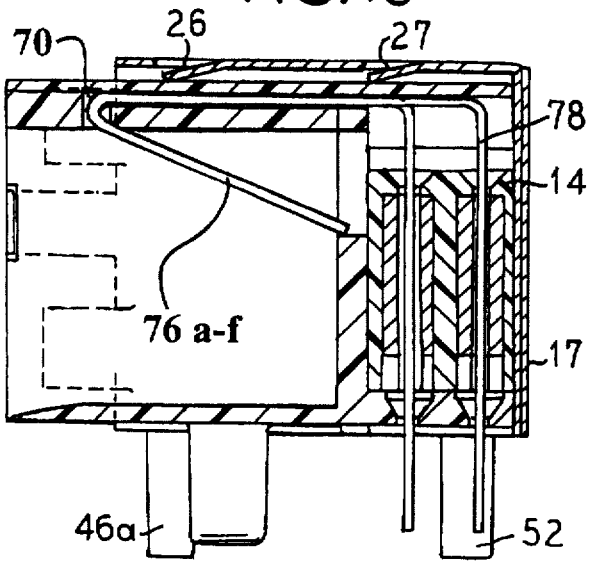
FIG. 10 is a sectional view of an assembled electrical jack of the invention.
Figure 11:
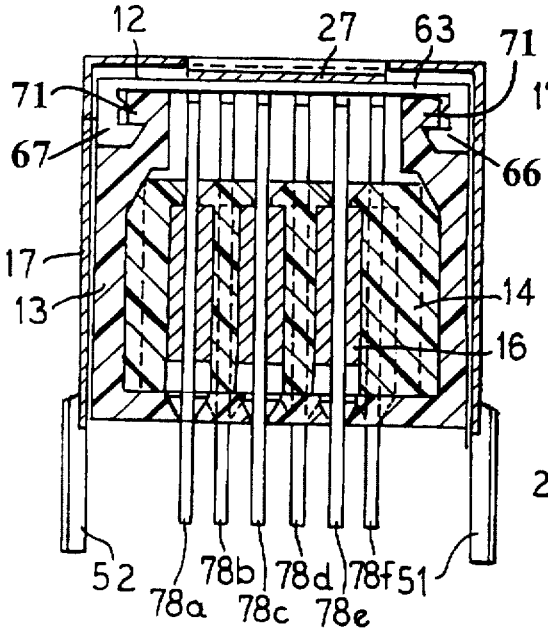
FIG. 11 is a sectional view of an assembled jack of the invention.

When assembling the electrical jack, the leads 18*a*–18*f* are inserted through the openings 101*a*–101*f* in the housing insert 14, with the ferrite sleeves 16*a*–16*f* in the openings of the housing insert 14. The ends 78*a*–78*f* extend through the openings 76*a*–76*f* of the rear portion 15 of the back housing 13. The lead portions 77*a*–77*f* are mounted in the grooves 73*a*–73*f* and through holes 70. Then, the back housing 13 with the housing insert 14 and leads mounted therein is inserted into the front housing 12 so that the units are firmly connected together. The front portions 76*a*–76*f* of the leads 18*a*–18*f* are bent at an angle and rest in mating grooves 91*a*–91*f* in the front portion of the front housing 12 as is illustrated, for example, in FIGS. 2 and 3 and 10. Then, the shield 17 is moved down over the front housing 12 and the back housing 13, and the extending tabs 21*b*, and 22*b* are bent around the front housing 12 so as to help lock the units together. The extending portions 46, 51, 52 of the shield 17 pass through aligned openings in the printed circuit board 11 and provide grounding contacts for the unit. The extensions 36, 37, 38, and 39, 41, 42 of the front housing 12 also extend through aligned openings of the printed circuit board 11 so as to lock the unit to the printed circuit board. The standoffs 8 and 9 space the electrical jack from the top surface of the printed circuit board 11. The downwardly extending tabs 26 and 27 in the shield 17 engage the top surface 63 of the front housing 12 as shown in FIG. 2.

The lower ends of the leads 18 designated as 78a–78f extend through the circuit board 11 and provide electrical inputs and outputs between the printed circuit board 11 and the connector.

Figure 12:
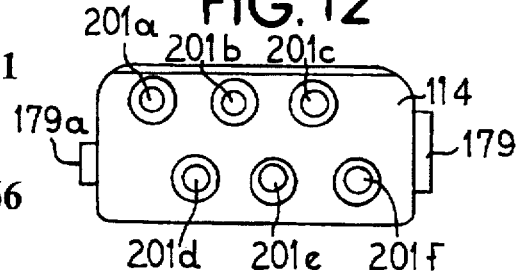
FIG. 12 illustrates a modified form of the housing insert.
Figure 13:
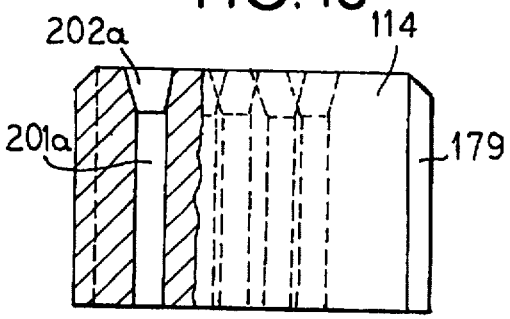
FIG. 13 is a sectional view illustrating the housing insert of FIG. 12.

FIGS. 12 and 13 illustrate a second embodiment of the housing insert 14 wherein the entire housing insert is formed of ferrite material. The housing insert is designated 114 and is formed with openings 201a–201f which have upward tapered portions 202a–202f. Extensions 179 and 179a are formed on the sides of the housing insert 114. In the embodiment of FIGS. 12 and 13, the ends 78a–78f of the leads 18 extend through the openings 201a–201f in the ferrite material of the housing insert 114 which provides filtering to remove undesirable high frequency signals from signals passing through the leads 18.

It is seen that the present invention provides a new and novel electrical jack which is formed of four or five parts plus the lead frame which forms an assembly which is compact and shielded. Ferrite cores or ferrite materials are used so as to remove undesirable high frequencies from the leads.

The present invention provides a compact and efficient assembly. The front portions 76a–76f of the leads 18a–18f extend at an angle in the front housing 14 as shown, for example, in FIG. 10 so that when the male connector unit, not shown, is inserted into the openings of the front housing 12 of the electrical jack, electrical contacts will be made there between. Also, shield tabs 21b and 22b will engage the male connector when it is inserted to establish a continuous ground connection between the male connector, the jack shield and the PCB ground.

Lead frame is enclosed, including top, for electrical isolation.

Shield tabs 61 mate with front housing depression 62, while top surface shield tabs 26 and 27 provide an upward force to keep tabs 61 engaged.

It is seen that this invention comprises a novel electrical jack and although the invention has been described with respect to preferred embodiments, it is not to be so limited as changes and modifications can be made which are within the full intended scope of the invention as defined by the appended claims.

I claim as my invention:

1. An electrical jack comprising a front housing formed with a front opening for receiving a mating male plug, a top opening formed through a top portion of said front housing, mounting extensions attached to said front housing, a generally L-shaped back housing slidably received in said top opening of said front housing, said back housing formed with a plurality of grooves wherein each of the plurality of grooves has an opening at one end extending through the L-shaped back housing, a back housing insert with a plurality of lead openings receivable in a mating opening in said back housing, and a plurality of electrical leads extending through a respective one of said openings at the end of each of the plurality of grooves in said back housing and into said front opening of said front housing and further wherein the plurality of electrical leads extend through the back housing insert and the back housing to terminate at one end exterior to the back housing.

2. The electrical jack according to claim 1 wherein the ends of said plurality of electrical leads in said front opening of said front housing are bent backwardly in said front opening.

3. The electrical jack according to claim 1 further comprising:

locking means between said front housing and said back housing.

4. The electrical jack according to claim 1 further comprising:

locking means between said back housing and said back housing insert.

5. The electrical jack according to claim 1 further comprising:

standoffs formed on the lower surface of said front housing so as to space it from a planar mounting means.

6. The electrical jack according to claim 1 further comprising:

an electrically conducting shield means receivable around said front housing, said back housing, said back housing insert and said plurality of electrical leads.

7. The electrical jack according to claim 6 further comprising:

locking means for locking said shield means to said front housing.

8. The electrical jack according to claim 6 wherein said shield means has extending grounding tabs for electrically grounding said shield means.

9. The electrical jack according to claim 1 further comprising:

ferrite material which at least partially surrounds said plurality of lead openings in said back housing.

10. The electrical jack according to claim 1 further comprising:

a plurality of ferrite inserts receivable in said plurality of lead openings in said back housing insert wherein said ferrite inserts are formed with openings through which said plurality of electrical leads extend.

11. The electrical jack according to claim 1 further comprising:

spaced projections mounted in said top opening of said front housing.

12. An electrical jack comprising a front housing formed with a front opening for receiving a mating male plug, a top opening formed through a top portion of said front housing, mounting extensions attached to said front housing, a generally L-shaped back housing slidably received in said top opening of said front housing, said back housing formed with a plurality of grooves wherein each of the plurality of grooves has an opening at one end extending through a leg of the L-shaped back housing, a back housing insert with a plurality of lead openings receivable in a mating opening in said back housing, and a plurality of electrical leads extending through said plurality of lead openings in said back housing insert, through a respective one of said openings at the end of each of the plurality of grooves in said back housing and into said front opening of said front housing; and an electrically conducting shield means receivable around said front housing, said back housing, said back housing insert and said plurality of electrical leads.

13. The electrical jack according to claim 12 further comprising:

locking means for locking the shield means to the front housing.

14. The electrical jack according to claim 12 wherein the shield means has extending grounding tabs for electrically grounding the shield means.

15. An electrical jack comprising a front housing formed with a front opening for receiving a mating male plug, a top opening formed through a top portion of said front housing, mounting extensions attached to said front housing, a generally L-shaped back housing slidably received in said top opening of said front housing, said back housing formed with a plurality of grooves, a back housing insert with a plurality of lead openings receivable in a mating opening in said back housing, and a plurality of electrical leads extending through said plurality of lead openings in said back housing insert, through said plurality of grooves in said back housing and into said front opening of said front housing; and ferrite material which at least partially surrounds said plurality of lead openings in said back housing.

16. An electrical jack comprising a front housing formed with a front opening for receiving a mating male plug, a top opening formed through a top portion of said front housing, mounting extensions attached to said front housing, a generally L-shaped back housing slidably received in said top opening of said front housing, said back housing formed with a plurality of grooves, a back housing insert with a plurality of lead openings receivable in a mating opening in said back housing, and a plurality of electrical leads extending through said plurality of lead openings in said back housing insert, through said plurality of grooves in said back housing and into said front opening of said front housing; and a plurality of ferrite inserts receivable in said plurality of lead openings in said back housing insert wherein said ferrite inserts are formed with openings through which said plurality of electrical leads extend.

17. An electrical jack comprising:

a front housing formed with a front opening for receiving a mating male plug;

a top opening formed through a top portion of the front housing;

mounting extensions attached to the front housing;

a generally L-shaped back housing slidably received in the top opening of the front housing wherein the back housing is formed with a plurality of grooves wherein each of the plurality of grooves has an opening at one end extending through a leg of the L-shaped back housing; and a plurality of lead openings receivable in a mating opening in the back housing wherein the plurality of electrical leads extend through a respective one of the openings at the end of each of the plurality of grooves in the back housing and into the front opening of the front housing and through a plurality of openings in the back housing to terminate at one end exterior to the back housing.

18. An electrical jack comprising a front housing formed with a front opening for receiving a mating male plug, a top opening formed through a top portion of said front housing, mounting extensions attached to said front housing, a generally L-shaped back housing slidably received in said top opening of said front housing, said back housing formed with a plurality of grooves, a back housing insert with a plurality of lead openings receivable in a mating opening in said back housing, and a plurality of electrical leads extending through said plurality of grooves in said back housing and into said front opening of said front housing and further wherein the plurality of electrical leads extend through the back housing insert and the back housing to terminate at one end exterior to the back housing; and ferrite material which at least partially surrounds said plurality of lead openings in said back housing.

19. An electrical jack comprising a front housing formed with a front opening for receiving a mating male plug, a top opening formed through a top portion of said front housing, mounting extensions attached to said front housing, a generally L-shaped back housing slidably received in said top opening of said front housing, said back housing formed with a plurality of grooves, a back housing insert with a plurality of lead openings receivable in a mating opening in said back housing, and a plurality of electrical leads extending through said plurality of grooves in said back housing and into said front opening of said front housing and further wherein the plurality of electrical leads extend through the back housing insert and the back housing to terminate at one end exterior to the back housing; and a plurality of ferrite inserts receivable in said plurality of lead openings in said back housing insert wherein said ferrite inserts are formed with openings through which said plurality of electrical leads extend.

* * * * *